United States Patent [19]

Fujiyama et al.

[11] 4,246,672

[45] Jan. 27, 1981

[54] AUTOMATIC INFLATABLE SAFETY WORK VEST

[75] Inventors: Hikaru Fujiyama; Masayoshi Shimada, both of Kawagoe, Japan

[73] Assignees: Nippon Oil and Fats Company, Limited; Fujikura Rubber Works, Limited, both of Tokyo, Japan

[21] Appl. No.: 31,145

[22] Filed: Apr. 18, 1979

[30] Foreign Application Priority Data

Jun. 30, 1978 [JP] Japan ..... 53-89255[U]

[51] Int. Cl.[3] ..... B63C 9/18

[52] U.S. Cl. ..... 9/321; 9/342; 222/3

[58] Field of Search ..... 9/314, 316, 318, 321, 9/325, 329, 333, 337, 338, 340, 341, 342; 222/3

[56] References Cited

U.S. PATENT DOCUMENTS

| | | | |
|---|---|---|---|
| 2,905,954 | 9/1959 | Lanciano, Jr. | 9/337 X |
| 3,426,942 | 2/1969 | McMains et al. | 9/318 X |
| 3,441,963 | 5/1969 | Steinthal | 9/314 |
| 4,094,028 | 6/1978 | Fujiyama et al. | 9/321 |

FOREIGN PATENT DOCUMENTS

| | | | |
|---|---|---|---|
| 2604943 | 8/1976 | Fed. Rep. of Germany | 9/321 |
| 1357742 | 6/1974 | United Kingdom | 9/342 |

*Primary Examiner*—Sherman D. Basinger
*Attorney, Agent, or Firm*—Stevens, Davis, Miller & Mosher

[57] ABSTRACT

An automatic inflatable safety work vest in which a gas is automatically charged into a gas tight chamber forming a floating body upon contacting water, comprises a back part of the vest formed of a non-floating material, a floating body provided at the front of the vest and connected with stretchable bands to the back part and having a gas tight chamber, a pillow integrally formed at the upper portion of the vest which communicates with the gas tight chamber, the pillows being folded over and releasably attached to the outer surface of the back part and a gas charging device in communication with the gas tight chamber and connected to the floating body through a connector, the gas charging device being a flat cylindrical vessel provided with a gas outlet at the bottom surface, a pair of electrodes positioned oppositely and fixed at a side wall near an upper cover portion of the cylindrical vessel, an electric switch provided at the upper portion of the cylindrical vessel and connecting to the electrodes and consisting of a power supply circuit, a charging circuit and a switching circuit, and an inner cylindrical vessel provided at the lower portion of the cylindrical vessel and provided with a bottom plate having a plurality of projections on the outside, a cylindrical perforated side wall having at least one projection and an electric ignition device fixed at the center portion and connecting to the switching circuit, the electric ignition device being in turn surrounded concentrically by, first, a gas generating solid agent and a solid cooling agent.

8 Claims, 6 Drawing Figures

AUTOMATIC INFLATABLE SAFETY WORK VEST

The present invention relates to an automatic inflatable safety work vest which automatically inflates and expands in a short time when getting into water without lowering the operative ability (meaning operation efficiency hereinafter, that is easiness of usual work on ships and the like) of the wearer when not inflated and expanded and can accurately float the face of the wearer on water surface upon inflating and expanding.

The requirements heretofore desired to be provided as the lifesaving jacket are as follows.

(1) Such a jacket inflates and expands automatically accurately in a short time upon contacting water.

(2) The operative ability during wearing is good and the storing ability in a preserving place upon putting off is good.

(3) It is possible to use the lifesaving jacket even in sea water and fresh water.

(4) The inflation and expansion of the jacket are not influenced by ambient temperature.

Heretofore, floating materials such as foamed styrol and the like, have been known as the lifesaving jacket. This satisfies the above described requirements (1), (3) and (4) but the floating material is bulky, so that the operative ability of the jacket wearer on ships and the like is poor.

Lifesaving jackets provided with a gas charging device capable of inflating and expanding only at the necessary time in order to improve this operative ability are known. That is, the lifesaving jacket is provided with a gas charging device using a high pressure gas bomb, which is provided with a sea water-activated electric cell or battery. This gas charging device is constituted with a main body which is provided with a gas outlet and houses an electric ignition device and an explosive. The jacket is provided with a pin in front of the ignition device and a high pressure gas bomb fixed to the main body and having a sealing plate provided in front of the pin, the electric ignition device being connected to a sea water-activated cell or battery. When this gas charging device is dipped in sea water, an electromotive force is caused on the sea water-activated cell or battery, which is an electric source, whereby the electric current flows into the electric ignition device. The ignition device ignites and explodes the front explosive and the pin is forwardly forced by the generated energy and breaks the sealing plate of the high pressure gas bomb which is the gas generating source, to supply gas. However, the lifesaving jacket provided with this gas charging device satisfies the above described requirement (1) in sea water but the sea water-activated cell or battery is used as the electric source of the gas charging device, so that this device cannot be used in fresh water. In addition, the high pressure gas bomb (for example, liquefied carbonic acid gas) is used as the gas source, so that the gas charging speed is influenced by the ambient temperature. Also, there is fear of leakage of gas in the storage and it is necessary to take maintenance into consideration. The gas charging device becomes large in size and becomes heavy, so that the movement of the wearing person is retarded.

As a gas charging device capable of being used in both fresh water and sea water, the gas charging device using the same high pressure gas bomb as described above as the gas source and using an electric switch constituting a closed circuit when dipped in water instead of sea water as the electric source is known (Japanese patent laid open application No. 94,119/76). In the electric switch used in this gas charging device, the electric ignition device is provided in series with a breakdown diode and in parallel to a capacitor and a resistor. They are connected to the positive pole side of the cell and a pair of electrodes are provided between the negative pole of the cell and the electric ignition device. Although this gas charging device can be used for both sea water and fresh water, there is a great difference in the operative time depending upon the kind of water. Since the high pressure gas bomb is used as the gas source, the lifesaving jacket provided with such a bomb prevents the operation on ship and the like as in the above described jacket and this problem has never been completely solved.

Furthermore, if the lifesaving jackets provided with these gas charging devices are worn, the volume when inflated and expanded and when not inflated and expanded is greatly different, so that if the lifesaving jacket is worn by a wearer in the non-inflated and unexpanded state, the breast of the person is compressed upon inflation and expansion. To prevent this compression, if the tight fitness of the lifesaving jacket wearer is rendered loose, the operation on ships becomes poor. Furthermore, the floating or buoyant body causing the floating force is provided at both the front and back sides of the wearer in any prior lifesaving jackets wherein the floating material is housed or a gas charging device is provided, so that even if the wearer contacts his face with the water surface by turning over or laterally, it is impossible to expose the face forcibly from the water surface. Even though persons fallen into trance, injured persons and the like may float, death from drowning is liable to occur.

The present inventors have diligently studied to obviate the drawbacks of the prior lifesaving jackets and succeeded by providing a gas tight chamber in front of an automatic inflatable safety work vest, providing a pillow integrally formed at the upper portion of the gas tight chamber and connecting the pillow to said chamber whereby the face of the wearer accurately floats on the water surface when the vest has been inflated and expanded, folding the pillow and fixing one end of the pillow to the outside of the back portion of the vest through a simple stopper to improve the operative ability of the wearer when the vest is not inflated and expanded, using a small, flat and light gas charging device for further improving the operative ability, said small gas charging device housing an electric switch which is closed when dipped in water, and a gas generating solid agent, and connecting the floating body positioning at the breast portion of the wearing person to the back portion of the vest with stretchable bands at the flank.

The automatically inflatable safety work vest according to the present invention comprises a back body having no buoyant force, a floating body provided with a gas tight chamber at the front portion, a pillow integrally formed at the upper portion, which connects to the gas tight chamber, and a small gas charging device connecting to the above described gas tight chamber in the floating body through a connector, said gas charging device consisting of a flat cylindrical vessel having an upper portion and a lower portion, which is provided with a gas outlet for feeding a gas into the above described gas tight chamber at the bottom of the lower portion, with a pair of oppositely positioned electrodes fixed at the side wall of said upper portion through an insulating material, and with an electric switch composed of a power source connecting to the above described electrodes in turn, a charging circuit and a switching circuit, said lower portion being a flat inner cylindrical vessel constituted with a bottom plate provided with a plurality of projections at the outside to form gas passage ways, a side wall composed of a perforated plate provided with at least one projection to form a gas passage way and a cover plate fitted with an electric ignition device at the center portion, which is connected to the above described switching circuit, said electric ignition device being surrounded with a circular gas generating solid agent, which is surrounded with a cylindrical inner perforated plate, and then surrounded with a cylindrical solid cooling agent.

The present invention will be explained in more detail.

For better understanding of the invention, reference is taken to the accompanying drawings, wherein.

Figure 1:
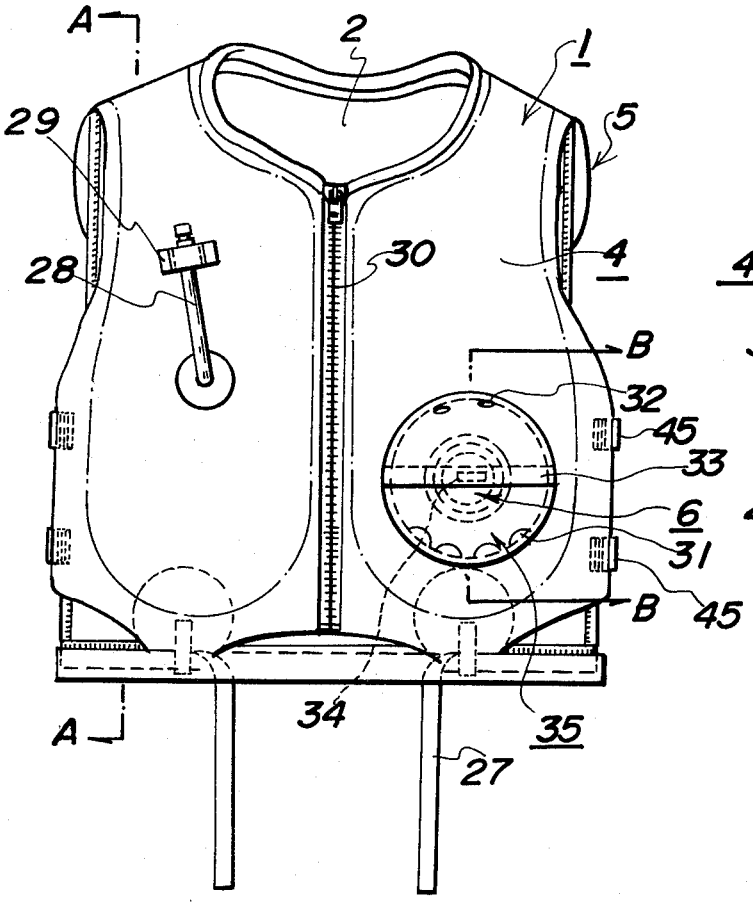
FIG. 1 is a schematic front view showing an embodiment of the automatic inflatable safety work vest according to the present invention.
Figure 2:
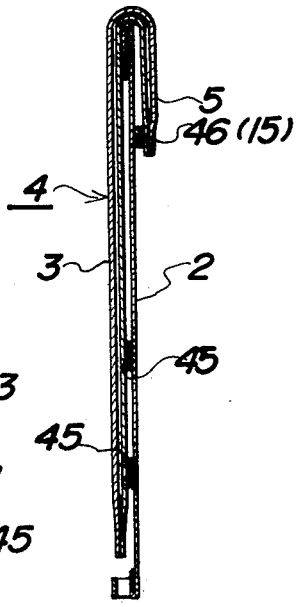
FIG. 2 is a cross-sectional view taken along the line A—A in FIG. 1.

Referring to FIG. 1, the automatic inflatable safety work vest 1 comprises a back part 2, a floating body 4 having a gas tight chamber 3 at the front portion, a pillow 5 integrally formed at the upper portion of said vest and connected to the gas tight chamber, and a small gas charging device 6 connected to the above described gas tight chamber 3. The back part 2 is formed of a non-floating material, such as cloth, and a band 27 is provided at the lower end. The numeral 45 represents stretchable connecting bands, one end of each of which is fixed to the inside of the back part and the other end is fixed to the inside of the floating body 4. The gas tight chamber 3 is provided in the floating body 4 is formed of a gas tight material, such as a rubber coated cloth and is formed by adhering the outer periphery edges of two rubber coated cloths. The end portion of the pillow 5 is attached to the outer surface of the back part 2 by simple stoppers 15, 46 such as a hook or a hook tape. When the gas tight chamber 3 is not inflated and expanded, the pillow 5 is folded over and fixed to the outer surface of the back part 2. When the gas tight chamber 3 is inflated and expanded, the simple stoppers 15 and 46 released due to the expansion of the gas tight chamber 3 and the pillow 5 stands up and positions at the back portion of the wearer's head. Numeral 28 is a manual gas charging device to be used for confirming the gas tightness of the gas tight chamber by previously filling air into the floating body 4 by mouth when wearing the vest prior to working or supplementing the contraction of the floating body 4 due to cooling of the gas after getting into the water as a gas charging means, when the gas charging device 6 is not operative and it is desirable to connect to the floating body 4 by communicating to the gas tight chamber 3 together with the small gas charging device 6. Moreover, it is preferable that the end of the device 28 is held at the floating body 4 by an anchoring piece 29 so that such an end would not be caught by nets and the like during working. Numeral 30 is a fastener which can freely unite and separate the floating body 4 at the front center portion. It is preferred that the gas charging device 6 connected to and communicating with the gas tight chamber 3 is covered with a water impermeable protective cover 35 so as not to be activated by water splash and the like. The protective cover 35 is bonded to the outer surface of the floating body 4 at the periphery and is provided with water feeding holes 31 at the lower portion and air discharging holes 32 at the upper portion. The cover 35 is formed by an upper part and a lower part so that these parts overlap at the center portion to form an overlapping portion 33 to allow changing of the gas charging device 6 and is closed by a simple stopper 34.

Figure 3:
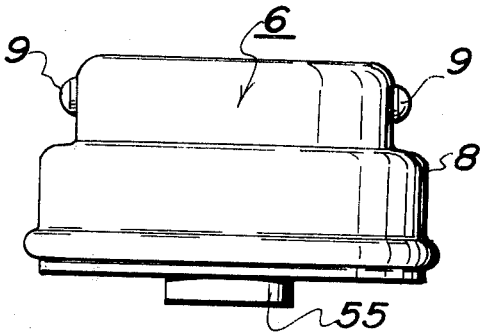
FIG. 3 is a side view of an embodiment of a small gas charging device to be used in the automatic inflatable safety work vest.

Referring to FIG. 3, the cylindrical vessel 8 of the gas charging device 6 has a flat cylindrical form in order not to retard the inflation and expansion of the floating body 4 upon inflating and expanding of said floating body and to improve the operative ability of the vest when worn. The vessel is composed of aluminum, aluminum alloys and the like to make the gas charging device light and corrosion resistant. The numeral 9 shows electrodes and the numeral 55 shows a screw thread portion for setting the gas charging device 6 to the connector adhered to the floating body.

Figure 4:
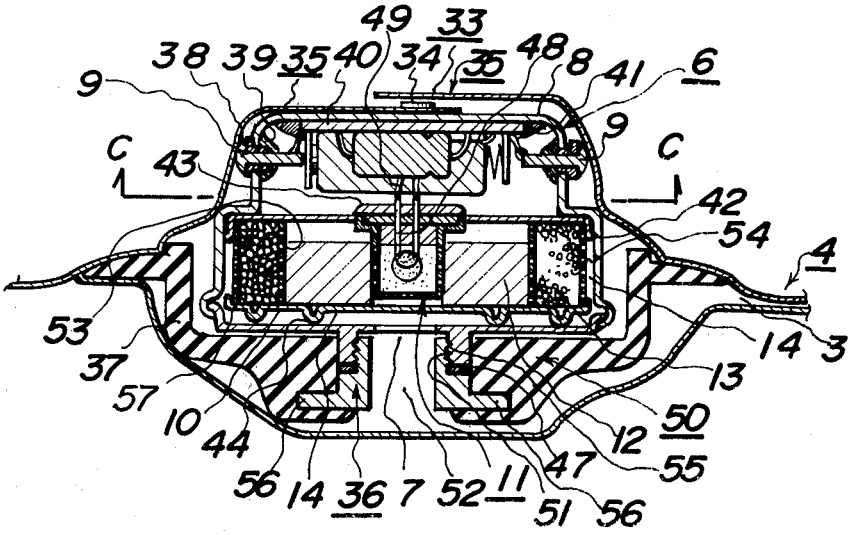
FIG. 4 is a cross-sectional view taken along the line B—B in FIG. 1 showing the part where the gas charging device is provided in the automatic inflatable safety work vest.

In FIG. 4, the gas charging device 6 is set in the floating body 4 through a connector 50. The connector 50 is flat in order to improve the operative ability of the wearer and is formed by embedding a flange portion 56 of a connecting metal 36 in a rubber seat 37 so as to securely fix the gas charging device 6. A rubber packing 47 is provided between the gas charging device 6 and the connecting metal 36 in order to prevent gas leakage. The gas charging device 6 is set to the connector 50 in the following manner. Firstly, the overlap portion 33 at the center of the protective cover 35 is opened by releasing the simple stopper 34. Portion 55 of the gas charging device is screwed into screw threads 51 of the aluminum connector 36 embedded in the rubber seat 37 previously adhered to the floating body 4. The numeral 52 shows a gas inlet connected to the gas outlet 7 of the gas charging device 6.

The small gas charging device 6 is assembled as follows.

In FIG. 4 at a side wall of an upper stage (having a smaller diameter) of a flat cylindrical vessel 8 having a two stage-formed concentric circle, a pair of copper electrodes 9 are secured so as to be mutually opposed by an insulating material 39 of epoxy resin through insulating sleeves 38.

Figure 5:
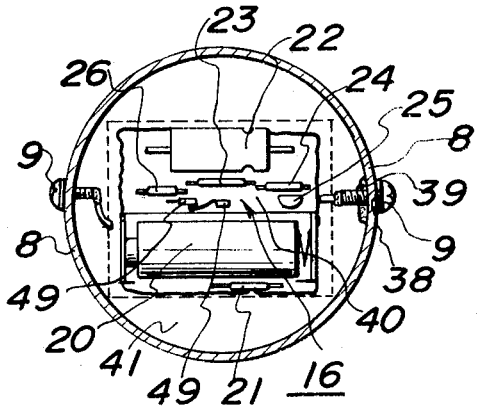
FIG. 5 is a cross-sectional view taken along the line C—C in FIG. 4 showing the electric switch.

The electric switch 16 shown in FIG. 5 is constituted by fixing a cell 20, a compensating resistor 21, a capacitor 22, a discharging resistor 23, a resistor 24 of voltage drop, PUT thyrister 25 and Zener diode 26 on a print circuit board 40 in order to render the gas charging device small and light. By wiring and fixing these elements, a power supply circuit 17 is constituted with the cell 20 and the compensating resistor 21, a charging circuit 18 is constituted with the capacitor 22 and the discharging resistor 23 and a switching circuit 19 is constituted with the resistor 24 for voltage drop, PUT thyrister 25 and Zener diode 26, and the print circuit board 40 is connected to the electrodes 9 shown in FIG. 5 and the print circuit board 40 is secured in the cylindrical vessel 8 with an insulating material 41 to form the electric switch 16. The switching circuit 19 may be one consisting of only Zener diode 26 and is merely necessary to be one which starts conduction at a voltage of more than a given value. The cell 20 used herein is preferred to be one which is a small size and does not cause self discharge even if the cell is used for a long period of time and for example, lithium cell, manganese cell, alkali cell and the like are selected. The use of the compensating resistor 21 is based on the reason that in order that the time necessary for inflating and expanding the floating body 4, is not influenced as far as possible by the kind of water, when inflating and expanding the floating body, it is necessary to approach the resistance value between the electrodes in sea water to the resistance value between the electrodes in fresh water. The resistance value between the electrodes greatly varies depending upon the kind of water and the value in fresh water is generally 1 kΩ~30 kΩ and the value in sea water is 0.1 kΩ~1 kΩ. Accordingly, the resistance value of the compensating resistor 21 is proper to be 1 kΩ~10 kΩ and when said value is less than 1 kΩ, the effect of the compensating resistor 21 is lower, that is the time necessary for inflating and expanding the floating body 4 is influenced by the kind of water and when said value is more than 10 kΩ, the time is too long and these values are not preferable.

Then, in FIG. 4, an inner cylindrical vessel 10 is provided with a perforated plate 54 at the side wall which is provided with the projections 42. An electric ignition device 11 is fitted at the center portion in the cover of said inner cylindrical vessel and secured by depositing an insulating material 43 on the fitted portion. Then, a cylindrically shaped gas generating solid agent 12 obtained by press-molding a mixture of a metal azide and a metal oxide, for example a mixture of sodium azide and manganese (IV) oxide, which generates a harmless gas consisting mainly of nitrogen gas, is arranged around the electric ignition device 11 and the outside of the gas generating agent is surrounded with granular solid cooling agent 13, for example, aluminum oxide through a perforated plate 53 and then a bottom plate 57 provided with a plurality of projections 44 is fitted to the inner cylindrical vessel 10.

Then, after the lead lines 48 of the electric ignition device 11 are connected to the lead lines 49 from the Zener diode 26 on the above described print circuit board 40, the inner cylindrical vessel 10 is housed in the above described cylindrical vessel 8. The numeral 14 is the gas passage way.

Concerning the automatic inflatable safety work vest according to the present invention, the function will be explained hereinafter.

When a person wearing the automatic inflatable safety work vest 1 falls into the sea, river, lake and the like by accident, or when said person must dive into the sea and the like urgently, if the inflatable safety work vest 1 is dipped in water, water enters through the water penetrating holes 31 of the protective cover 35 of said vest and air in the protective cover 35 is discharged from the air discharging holes 32. When the water penetrates into the circumference of the gas charging device 6 and the pair of electrodes 9 are dipped in water and both electrodes are short-circuited by water, the capacitor 22 of the charging circuit 18 is charged by the cell 20 of the power supply circuit 17 and when the charged voltage reaches the necessary voltage to make Zener diode 26 of the switching circuit 19 breakdown, the current from the capacitor 22 flows through the Zener diode 26 and flows into the electric ignition device 11 and the electric ignition device 11 ignites. The surrounding gas generating agent is burnt to generate a gas having a high temperature, which consists mainly of nitrogen gas. The generated gas having a high temperature passes through the upper space of the gas generating solid agent 12, through the perforated plate 53 and then between granules of the solid cooling agent 13. Thus, the gas having a high temperature is cooled and purified. The cooled and purified gas has such a temperature that the floating body 4 is not damaged. The gas passes through the perforated plate 54 provided at the side wall of the inner cylindrical vessel 10, through the gas passage way 14, through the gas inlet 52 of the connector 50 from the gas outlet 7 in the gas charging device and into the gas tight chamber 3 of the automatic inflatable safety work vest 1 to inflate and expand the floating body 4 and the pillow 5. In this case, since the floating force of the floating body 4 is larger than the floating force of the pillow 5 and the connecting bands 45 at the flank stretch, the floating body 4 expands frontward. Simultaneously, the pillow 5 fixed at the outside of the back part 2 by the simple stoppers 15 and 46 is released and positions itself at the back portion of the wearer's head to float the face on the water surface.

The time from dipping in water to the completion of inflating and expanding of the floating body is about 2~5 seconds.

The time from dipping in water until gas is generated by burning of the gas generating agent whereby the generated gas flows into the floating body and the inflation and expansion of the automatic inflatable safety vest are started, that is, the waiting time t (sec.) of the gas charging device can be calculated from the following formula:

$$t = RCln\ (1\text{-}Va/E).$$

In the above formula, $$R = R_1 + R_2$$

$R_1$: Resistance value (Ω) between the electrodes,
$R_2$: Resistance value (Ω) of the compensating resistor.
C: Capacity (F) of the capacitor.
E: Cell voltage (V).
Va: Breakdown voltage (V) of the switching element.

Namely, the waiting time is influenced by the resistance value between the electrodes, the resistance value of the compensating resistor, the capacity of the capacitor, the cell voltage, and the breakdown voltage of the switching element.

The following example is given for the purpose of illustration of this invention and is not intended as limitations thereof.

EXAMPLE

Figure 6:
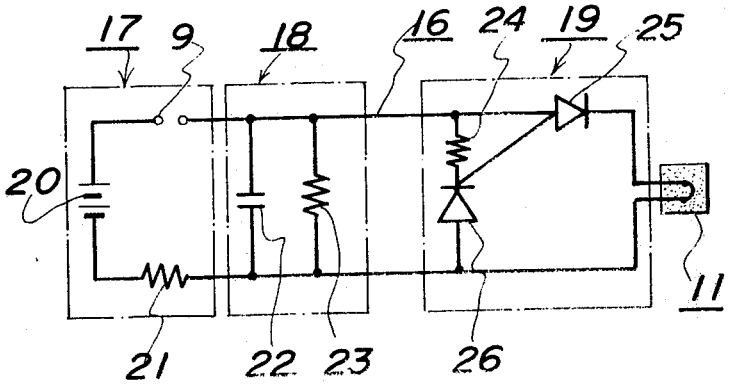
FIG. 6 is a circuit view of the electric switch.

In the circuit view of the electric switch 16 of FIG. 6, copper electrodes 9 were used, the voltage of lithium cell 20 was 12 V, the capacity of the capacitor 22 was 100 μF, the resistance value of the discharging resistor 23 was 100 kΩ, the breakdown voltage of Zener diode 26 was 7 V, the resistance value of the resistor for voltage drop was 50 kΩ and the resistance value of the compensating resistor 21 was 10 kΩ. Such an electric switch 16 was assembled in the gas charging device 6 and this gas charging device 6 was provided in the automatic inflatable safety work vest 1 shown in FIG. 1.

A person wearing this automatic inflatable safety work vest 1 dove into a pool filled with city water at 20° C. and the operating time of the small size of gas charging device was measured. The time was 2.8 seconds. After the floating body had inflated and expanded, the face of the wearer completely floated on the water surface.

When a person wearing the same automatic inflatable safety work vest as described above dove into sea water at 17° C. and the operating time of the same gas charging device as described above was measured, the operating time was 1.2 second. The face of the wearing person floated on sea surface in the same manner as in the pool.

To the breast of a person wearing the same automatic inflatable safety work vest as described above, was sprayed city water at 20° C. from a place distant about 3 m by means of a vinyl hose for 1 minute, but the gas charging device did not operate.

Then, sea water at 17° C. fully charged in 18 l of bucket was sprayed on the head of a person wearing the same automatic inflatable safety work vest as used in the above described tests, but the gas charging device did not operate.

As seen from the above described Example, in the automatic inflatable safety work vest according to the present invention, the electric switch of the gas charging device provided in said vest is constituted so as to close the circuit by dipping the electrodes in water, so that there is no such drawback that the lifesaving jacket can be used only in sea water as in the prior gas charging device using sea water-activated cell and can not be used in fresh water. The gas charging device according to the present invention can be accurately actuated automatically in a short time in any kind of water. Furthermore, the electrodes are arranged oppositely at the side wall of the flat cylindrical vessel of the gas charging device and the outside of said device is covered by the protective cover, so that said device is not activated by water splash and the reliability is high.

Furthermore, in the automatic inflatable safety work vest according to the present invention, the floating body and the pillow inflate and expand upon contacting water and the pillow positions itself behind the wearer's head, so that the head portion, particularly the face of the wearer is always above the water surface. In previous lifesaving jackets, the wearer's face may be beneath the water surface during turning even though the wearer is floating.

The automatic inflatable safety work vest according to the present invention has the following characteristics.

The present vest can tightly fit to the wearer when not inflated and the gas charging device to be provided can house the electric source and the gas generating source in a common vessel without separating the electric source and the gas generating source as in the conventional gas charging device, whereby the gas charging device can be made small, so that the operative ability of the wearing person is excellent.

In addition, when inflated and expanded, the back part and the floating body are connected by stretchable bands at the flank, so that the breast of the wearer is not compressed.

Moreover, in the small gas charging device provided in the automatic inflatable safety work vest according to the present invention, a gas generating solid agent is used as the gas source, so that the generated gas is not cold and the warm gas can be fed to the gas tight chamber, so that even in winter or cold water zone, the wearer can be kept in the water. After staying in the water for a long time, the temperature of the gas gradually lowers and therefore the volume of the floating body more or less reduces, so that in such a case it is possible to blow air directly from the mouth of the wearer by using the manual gas charging device. In this case, the gas charged into the gas tight chamber is nitrogen gas and is harmless to the wearer. In addition, since a gas generating solid agent is used, so that the rate of gas charged into the gas tight chamber is not influenced by the ambient temperature as in the conventional high pressure gas bomb and further any gas leakage during storage does not occur, so that there is no problem in maintenance. The present automatic inflatable safety work vest can be used at any time and its reliability is high.

Furthermore, in the present gas charging device, the gas generating solid agent and the solid cooling agent are arranged in multi-circular form in an inner cylindrical vessel but in order to form gas passage ways, a space portion is provided at the outside of the inner cylindrical vessel and a plurality of projections are provided at the bottom plate of the inner cylindrical vessel, so that the passage of gas is good and the inner pressure of the vessel in the gas generating vessel does not increase, so that the flat cylindrical vessel is not necessarily a pressure resistant vessel as in the prior high pressure gas bomb. As a result, the gas charging device is small and light, so that the operative ability of the wearer can be improved and further the storing ability in the storage place is high.

As explained in detail, the automatic inflatable safety work vest according to the present invention provides good operative ability to the wearer, accurately inflates and expands automatically in a short time irrespective of the kind of water it contacts and can float the wearer's face above the water surface.

What is claimed is:

1. An automatically inflatable safety work vest in which a gas is automatically charged into a gas tight chamber forming a floating body upon contacting water, which comprises a back part of the vest formed of a non-floating material, a floating body provided at the front of the vest and connected with stretchable bands to the back part and having a gas tight chamber, a pillow integrally formed at the upper portion of the vest which communicates with said gas tight chamber, said pillow being folded over and having the free end thereof fixed releasably to the outer surface of said back part and a gas charging device in communication with said gas tight chamber and connected to the floating body through a connector, said gas charging device being a flat cylindrical vessel provided with a gas outlet at the bottom surface, a pair of electrodes positioned oppositely and fixed at a side wall near an upper cover portion of said cylindrical vessel, an electric switch provided at the upper portion of said cylindrical vessel and connected to said electrodes and consisting of a power supply circuit, a charging circuit and a switching circuit, and an inner cylindrical vessel provided at the lower portion of said cylindrical vessel and provided with a bottom plate having a plurality of projections at the outside, a cylindrical perforated side wall having at least one projection and an electric ignition device fixed at the center portion and connected to said switching circuit, said electric ignition device being in turn surrounded concentrically by, first, a gas generating solid agent and, second, a solid cooling agent.

2. The automatically inflatable safety work vest as claimed in claim 1, wherein the power supply circuit consists of a cell and a compensating resistor connected in series to said cell, the charging circuit consists of a parallel combination of a capacitor and a discharging resistor connected in parallel to said power supply circuit and the switching circuit is one which is closed to supply electric power to the electric ignition device when the capacitor reaches a given charging voltage.

3. The automatically inflatable safety work vest as claimed in claim 2, wherein said switching circuit consists of Zener diode, PUT thyristor and a resistor for voltage drop.

4. The automatically inflatable safety work vest as claimed in claim 1, wherein the connector connecting the floating body and the gas charging device comprises a connected metal connecting to a gas outlet of the gas charging device and having a flange portion at the lower end, a rubber seat embedding the flange portion of the connecting metal at the center portion and adhered to the floating body at the outer periphery and a rubber packing arranged between the gas charging device and the connecting metal.

5. The automatically inflatable safety work vest as claimed in claim 1, wherein the pillow is attached to the outer surface of the back part of the vest in such a manner that the attachment is released when the floating body is inflated and expanded.

6. The automatically inflatable safety work vest as claimed in claim 1, wherein the gas generating solid agent consists mainly of a metal azide and a metal oxide.

7. The automatically inflatable safety work vest as claimed in claim 1, wherein the gas charging device is covered with a protective cover composed of a water impermeable material, which is formed by overlapping an upper cover part provided with air discharging holes and a lower cover part provided with water penetrating holes at the center portion.

8. The automatically inflatable safety work vest as claimed in claim 1, wherein a manual gas charging device is provided on the floating body so that said device is in communication with the gas tight chamber together with the gas charging device.

* * * * *